US010202922B2

(12) United States Patent
Yamashita et al.

(10) Patent No.: US 10,202,922 B2
(45) Date of Patent: Feb. 12, 2019

(54) STARTUP CONTROL DEVICE, LOCK DETERMINATION METHOD, AND METHOD FOR CONTROLLING STARTER MOTOR

(71) Applicant: HONDA MOTOR CO., LTD., Tokyo (JP)

(72) Inventors: Hideaki Yamashita, Wako (JP); Yasumasa Kaitani, Wako (JP); Thomas Henry Crise, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/717,942

(22) Filed: Sep. 28, 2017

(65) Prior Publication Data

US 2018/0149104 A1 May 31, 2018

(30) Foreign Application Priority Data

Nov. 29, 2016 (JP) ..... 2016-231204

(51) Int. Cl.
*F02N 11/00* (2006.01)
*F02D 41/06* (2006.01)
(Continued)

(52) U.S. Cl.
CPC ..... *F02D 41/062* (2013.01); *F02N 11/0803* (2013.01); *F02N 11/10* (2013.01);
(Continued)

(58) Field of Classification Search
CPC .. F02D 41/061; F02D 41/062; F02D 2200/50; F02D 2200/101; F02N 11/10;
(Continued)

(56) References Cited

U.S. PATENT DOCUMENTS 6,363,899 B1 * 4/2002 Koelle ..... F02N 11/0848 123/179.3
6,688,270 B2 * 2/2004 Hisamoto ..... F02N 11/0848 123/179.25
(Continued)

FOREIGN PATENT DOCUMENTS

JP 4345236 B2 9/2002
JP 2008-196456 8/2008

*Primary Examiner* — Thomas Moulis
(74) *Attorney, Agent, or Firm* — Mori & Ward, LLP

(57) ABSTRACT

A startup control device controls a starter motor. The startup control device includes lock determination circuitry and motor control circuitry. The lock determination circuitry estimates a current value supplied to the starter motor based on a temperature of a battery, a remaining electricity amount in the battery, and an output voltage of the battery when the battery supplies electricity to the starter motor, determines a threshold period of time according to the current value estimated, and determines that an internal combustion engine does not start if a rotational speed of the internal combustion engine does not exceed a referenced speed within the threshold period of time after starting supplying electricity to the starter motor. The motor control circuitry stops supplying electricity to the starter motor when the lock determination circuitry determines that the internal combustion engine does not start after starting supplying electricity to the starter motor.

20 Claims, 4 Drawing Sheets

(51) Int. Cl.
*F02N 11/08* (2006.01)
*F02N 11/10* (2006.01)

(52) U.S. Cl.
CPC .... *F02D 2200/101* (2013.01); *F02D 2200/50* (2013.01); *F02N 11/0862* (2013.01); *F02N 2200/022* (2013.01); *F02N 2200/043* (2013.01); *F02N 2200/044* (2013.01); *F02N 2200/061* (2013.01); *F02N 2200/064* (2013.01)

(58) Field of Classification Search
CPC ..... F02N 11/0803; F02N 2200/043; F02N 2200/064; F02N 2200/044; F02N 2200/061; F02N 2200/022; F02N 11/0862
See application file for complete search history.

(56) References Cited

U.S. PATENT DOCUMENTS

| | | | | |
|---|---|---|---|---|
| 6,799,546 | B1 * | 10/2004 | Gonring | F02N 11/0803 123/179.3 |
| 8,770,165 | B2 * | 7/2014 | Mizuno | F02D 29/06 123/179.3 |
| 9,404,466 | B2 * | 8/2016 | Du | F02N 11/108 |
| 9,863,390 | B2 * | 1/2018 | Hirabayashi | F02N 11/0848 |
| 10,060,985 | B2 * | 8/2018 | Siekkinen | G01R 31/3606 |
| 2001/0054407 | A1 * | 12/2001 | Ooizumi | F02N 11/10 123/179.3 |
| 2009/0115419 | A1 * | 5/2009 | Ueda | G01R 31/3624 324/430 |
| 2009/0241884 | A1 * | 10/2009 | Saitoh | F02N 11/0825 123/179.4 |
| 2016/0011275 | A1 * | 1/2016 | Saito | F02N 11/0862 324/430 |

* cited by examiner

STARTUP CONTROL DEVICE, LOCK DETERMINATION METHOD, AND METHOD FOR CONTROLLING STARTER MOTOR

CROSS-REFERENCE TO RELATED APPLICATIONS

The present application claims priority under 35 U.S.C. § 119 to Japanese Patent Application No. 2016-231204, filed Nov. 29, 2016. The contents of this application are incorporated herein by reference in their entirety.

BACKGROUND OF THE INVENTION

Field of the Invention

The present invention relates to a startup control device, to a lock determination method, and to a method for controlling a starter motor.

Discussion of the Background

Conventionally, in a vehicle or the like using an internal combustion engine started by cranking by a starter motor, if startup of the internal combustion engine is not started within a certain time after start of energization of the starter motor (e.g., if the speed of the internal combustion engine does not reach a predetermined speed or higher) at the time of startup of the internal combustion engine, energization of the starter motor is stopped to prevent undesired load on the starter motor or undesired power consumption.

In Japanese Patent Application Publication No. 2008-196456, in order to accurately determine the possibility that an engine starts to improve startability of the engine, it is determined whether each of a charged capacity and degree of degradation of a battery, a speed of the engine during cranking, a voltage value of the battery when a rush current flows into a starter motor, and a voltage value of the battery during cranking exceeds a predetermined range. The level of possibility that the engine starts is determined according to the number of values that are determined to exceed the range. Then, an electricity generation amount of an alternator is increased, or power consumption by a radio, a seat heater and the like is reduced depending on the determination result.

Japanese Patent No. 4345236 aims to ensure startability of an internal combustion engine, even when there is a problem in a transmission system of a detection signal indicating whether a starter motor has been energized, the transmission system connected to a controller that controls the amount of fuel and the like fed to the internal combustion engine at the time of startup. Here, the controller determines that the starter motor has been energized, if a state where the speed of the internal combustion engine is equal to or lower than a predetermined speed and the voltage of a power source that energizes the starter motor is equal to or lower than a predetermined value is continued for a predetermined time or longer.

SUMMARY

According to one aspect of the present invention, a startup control device controls operation of a starter motor for starting an internal combustion engine. The startup control device includes an energization controller that turns on and off energization of the starter motor by a battery and a lock determination part that determines whether the internal combustion engine is in a locked state where the internal combustion engine is not started by the starter motor. The energization controller is configured to stop energization of the starter motor when the lock determination part determines that the internal combustion engine is in a locked state after energization of the starter motor and the lock determination part is configured to estimate an energization current value of the starter motor based on a temperature of the battery, an SOC of the battery, and an output voltage of the battery when energizing the starter motor, set, to a first time, a lock determination time between start of energization of the starter motor and determination that the internal combustion engine is in a locked state, according to the estimated energization current value, and determine that the internal combustion engine is in a locked state if a speed of the internal combustion engine does not exceed a predetermined speed before an elapsed time after energization of the starter motor exceeds the set lock determination time.

According to another aspect of the present invention, a lock determination method determines whether an internal combustion engine is in a locked state where the internal combustion engine is not started by a starter motor. The method includes the steps of acquiring an SOC of a battery that energizes the starter motor, acquiring an output voltage of the battery when energizing the starter motor, estimating an energization current value of the starter motor based on a temperature of the battery, the acquired SOC, and the output voltage setting, to a first time, a lock determination time between start of energization of the starter motor and determination that the internal combustion engine is in a locked state, according to the estimated energization current value and determining that the internal combustion engine is in a locked state if a speed of the internal combustion engine does not exceed a predetermined speed before an elapsed time after energization of the starter motor exceeds the set lock determination time.

According to further aspect of the present invention, a startup control device controls a starter motor. The startup control device includes lock determination circuitry and motor control circuitry. The lock determination circuitry is configured to estimate a current value supplied to the starter motor based on a temperature of a battery that is configured to supply electricity to the starter motor to start an internal combustion engine, a remaining electricity amount in the battery, and an output voltage of the battery when the battery supplies the electricity to the starter motor, determine a threshold period of time according to the current value estimated, and determine that the internal combustion engine does not start if a rotational speed of the internal combustion engine does not exceed a referenced speed within the threshold period of time after starting supplying electricity to the starter motor. The motor control circuitry is to stop supplying electricity to the starter motor when the lock determination circuitry determines that the internal combustion engine does not start after starting supplying electricity to the starter motor.

According to further aspect of the present invention, a method controls a starter motor. The method includes estimating a current value supplied to the starter motor based on a temperature of a battery that is configured to supply electricity to the starter motor to start an internal combustion engine, a remaining electricity amount in the battery, and an output voltage of the battery when the battery supplies the electricity to the starter motor, determining a threshold period of time according to the current value estimated, and determining that the internal combustion engine does not start if a rotational speed of the internal combustion engine does not exceed a referenced speed within the threshold period of time after starting supplying electricity to the starter motor.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
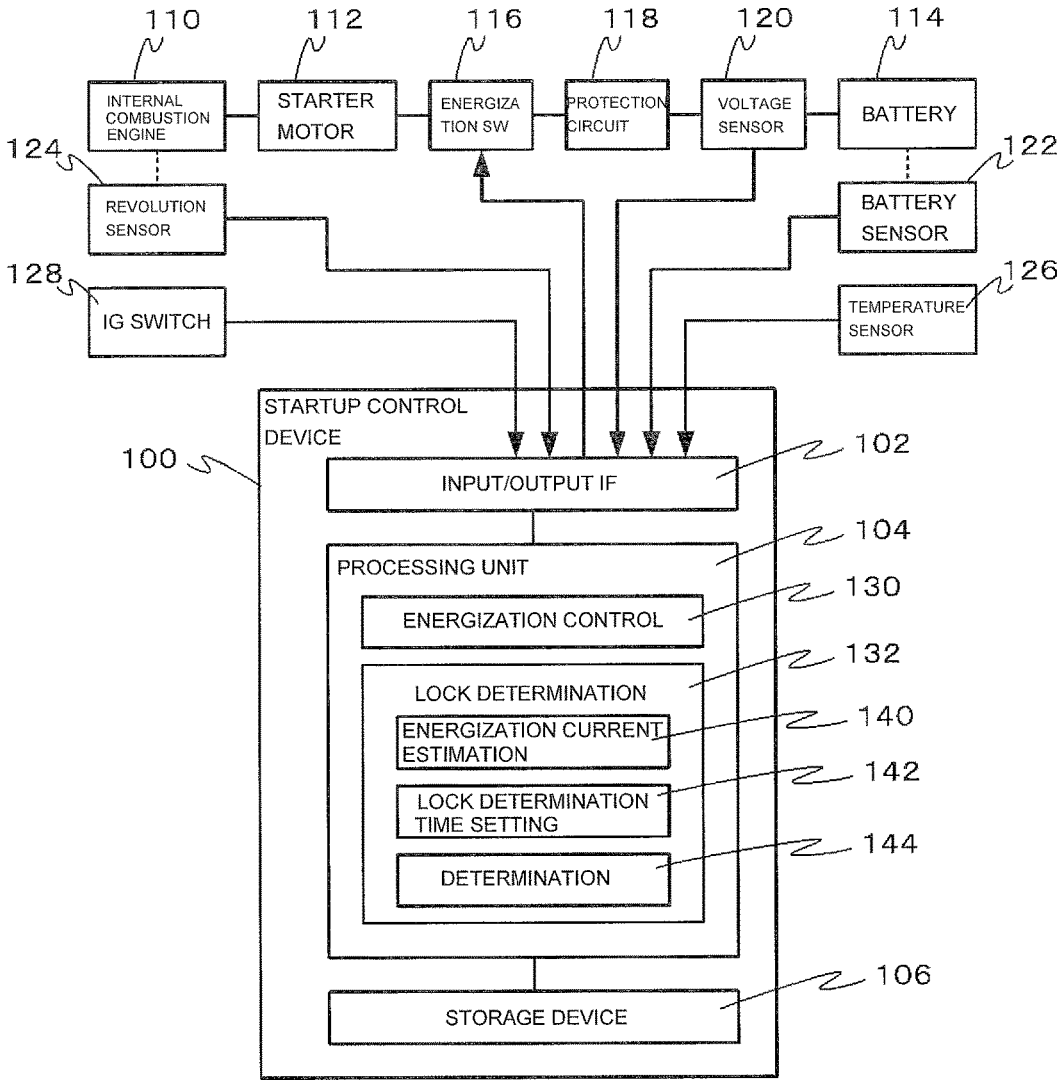
FIG. 1 is a diagram illustrating a configuration of a startup control device of an embodiment of the present invention.

The embodiments will now be described with reference to the accompanying drawings, wherein like reference numerals designate corresponding or identical elements throughout the various drawings.

FIG. 1 is a diagram illustrating a configuration of a startup control device of an embodiment of the present invention.

A startup control device 100 includes an input/output interface 102, a processing unit 104, and a storage device 106.

The input/output interface 102 is an interface for receiving a signal from an external device such as a later-mentioned voltage sensor 120 and transmitting it to the processing unit 104, and is an interface for transmitting a signal from the processing unit 104 to an external device such as a later-mentioned energization switch 116.

When starting an internal combustion engine 110 included in a vehicle (hereinafter referred to as host vehicle) in which the device 100 is provided, the startup control device 100 controls the energization switch 116 through the input/output interface 102, for example, to turn on and off energization, by a battery 114 which is a lead battery, for example, of a starter motor 112 that performs cranking of the internal combustion engine 110. In the embodiment, a protection circuit 118 including a fuse (not shown) for overcurrent protection is provided in a power supply line from the battery 114 to the starter motor 112. This protects the starter motor 112 and the battery 114 from failure due to overcurrent.

The startup control device 100 acquires, through the input/output interface 102, a battery voltage detection value from the voltage sensor 120 that measures an output voltage (hereinafter also referred to as battery voltage) of the battery 114, an SOC detection value from a battery sensor 122 that measures an SOC (state of charge) of the battery 114, an engine speed detection value from a revolution sensor 124 that detects the speed of the internal combustion engine 110, an ambient temperature detection value from a temperature sensor 126 that detects the ambient temperature of the battery 114, and a startup start signal from an ignition switch 128 that instructs start of a startup of the internal combustion engine 110.

The storage device 106 pre-stores data necessary for processing performed by the processing unit 104, and also temporarily stores data generated while performing the processing.

The processing unit 104 is a computer that has a processor such as a CPU (central processing unit), a ROM (read only memory) into which a program is written, and a RAM (random access memory) for temporarily storing data, for example. The processing unit includes an energization control unit (motor control circuitry) 130 and a lock determination unit 132, and the lock determination unit (lock determination circuitry) 132 includes an energization current estimation unit 140, a lock determination time setting unit 142, and a determination unit 144.

The above units included in the processing unit 104 are implemented by executing a program by the processing unit 104 which is a computer, and the computer program may be stored in an arbitrary computer readable storage medium. Instead or in addition to this, all or some of the above units may each be configured of hardware including one or more electronic circuit components.

The energization control unit 130 controls energization (on/off) of the starter motor 112 by the battery 114. More specifically, upon receipt of a startup start signal instructing start of a startup of the internal combustion engine 110 from the ignition switch 128 when the driver operates the ignition switch 128, for example, the energization control unit 130 turns on the energization switch 116 and starts energization of the starter motor 112. After starting energization of the starter motor 112, when the speed of the internal combustion engine 110 exceeds a predetermined determination speed or when it is determined by the later-mentioned lock determination unit 132 that the internal combustion engine 110 is in a locked state, the energization control unit 130 turns off the energization switch 116 and stops energization of the starter motor 112.

After energization of the starter motor 112 is started by the energization control unit 130, the lock determination unit 132 determines whether the internal combustion engine 110 is in a locked state where it cannot be started by the starter motor 112. More specifically, the lock determination unit 132 estimates the energization current of the starter motor 112 by the energization current estimation unit 140, and sets a lock determination time for determining the locked state according to the estimated energization current by the lock determination time setting unit 142. Then, the lock determination unit 132 determines, by the determination unit 144, that the internal combustion engine 110 is in a locked state if the speed of the internal combustion engine 110 does not exceed a predetermined value before the time elapsed from the start of energization of the starter motor 112 exceeds the lock determination time.

To be more specific, the energization current estimation unit 140 estimates the energization current applied to the starter motor 112 from the battery 114, based on the ambient temperature acquired from the temperature sensor 126, the SOC of the battery 114 acquired from the battery sensor 122, and the current output voltage of the battery 114 acquired from the voltage sensor 120.

Figure 2:
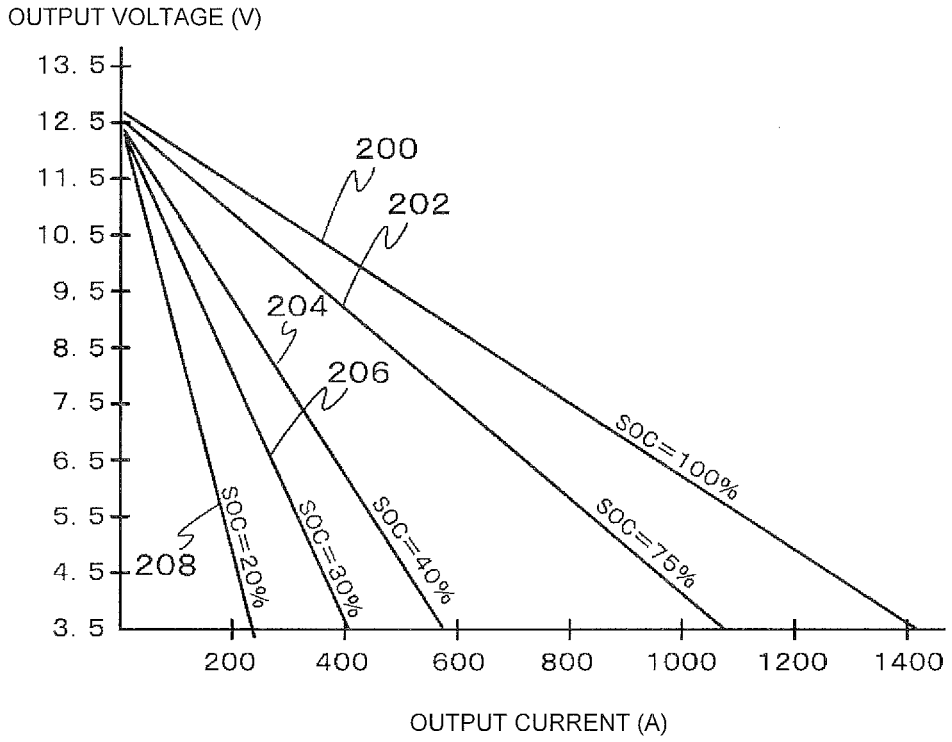
FIG. 2 is a diagram illustrating an example of relationships between an output voltage and an output current of various SOCs in a battery that drives a starter motor.

FIG. 2 is a diagram illustrating an example of a relationship between the output current (i.e., energizing current of starter motor 112) of the battery 114 at normal temperature and the output voltage. In FIG. 2, the horizontal axis indicates the output current, and the vertical axis indicates the output voltage. Although the ideal internal resistance (output impedance) of the battery 114 is zero, in reality, the internal resistance is a finite value. Therefore, the output voltage of the battery 114 decreases along with increase of the output current. The value of an output current at one output voltage depends on the SOC of the battery 114, and the larger the SOC, the larger the output current.

Lines 200, 202, 204, 206, 208 indicated in FIG. 2 respectively indicate the relationship between the output voltage and the output current when the SOC is 100%, 75%, 40%, 30%, 20%. For example, the output current at one output voltage 3.5V is about 240, 405, 580, 1080, 1405A when the SOC is 100%, 75%, 40%, 30%, 20%, respectively. Accordingly, when the current battery voltage (output voltage) acquired from the voltage sensor 120 is 3.5V and the SOC acquired from the battery sensor 122 is 40%, for example, an estimate of the current energization current of the starter motor 112 (i.e., output current) is 580A.

While FIG. 2 is a diagram of a case where the temperature (battery temperature) of the battery 114 is normal temperature, generally, the higher the battery temperature, the gentler the inclination of lines 200, 202, 204, 206, 208. For example, line 204 where SOC=40% in FIG. 2 indicating characteristics at normal temperature intersects with the horizontal axis of 3.5V output voltage at a point where the output current value is about 570A. Meanwhile, if the battery temperature rises, the inclination of line 204 becomes gentler, and if the battery temperature reaches 50° C., line 204 intersects with the horizontal axis of 3.5V output voltage at an about 600A point. In other words, the higher the battery temperature, the larger the output current value corresponding to one output voltage value.

In the embodiment, a current estimation map indicating the relationship between the output voltage and the output current for various SOCs of the battery 114 as illustrated in FIG. 2, for example, is pre-stored in the storage device 106 for each of various temperatures of the battery 114. The energization current estimation unit 140 acquires the ambient temperature acquired from the temperature sensor 126 as a battery temperature, and uses the battery temperature, the SOC of the battery 114 acquired from the battery sensor 122, and the current output voltage of the battery 114 acquired from the voltage sensor 120 to refer to the current estimation map corresponding to the aforementioned acquired battery temperature, which is stored in the storage device 106. Then, the energization current estimation unit calculates the current output current of the battery 114, that is, the current energization current value of the starter motor 112, in the aforementioned manner as an energization current estimation value.

Referring back to FIG. 1, the lock determination time setting unit 142 sets the lock determination time to a first time, according to the energization current estimation value calculated by the energization current estimation unit 140. In the embodiment, the first time is assumed to be a predetermined constant value. The lock determination time setting unit 142 sets the lock determination time to the first time which is the aforementioned predetermined constant value, when the energization current estimation value is not smaller than a predetermined determination current value. The lock determination time setting unit 142 also sets the lock determination time to a second time longer than the first time, when the energization current estimation value is smaller than the determination current value.

The first time may be a time within a range where load (e.g., heating value of starter motor 112 and temperature rise value) applied on the starter motor 112 reaches a predetermined level when the energization current estimation value at the time is continuously applied to the starter motor 112. Instead, the first time may be a time within a range where the fuse included in the protection circuit 118 is not blown out when the energization current estimation value at the time is continuously applied to the starter motor 112. Alternatively, the first time may be the shorter one of the time before load on the starter motor 112 reaches the predetermined level, and the time within the range where the fuse is not blown out.

Meanwhile, the second time maybe a time within a range where load on the starter motor 112 reaches the predetermined level and/or a time within a range where the fuse included in the protection circuit 118 is not blown out, when an energization current value (i.e., predetermined rated value of energizing current or typical value) of the starter motor 112 when the battery temperature, battery SOC, and battery output voltage are predetermined rated values (or typical values), is continuously applied to the starter motor 112.

Figure 3:
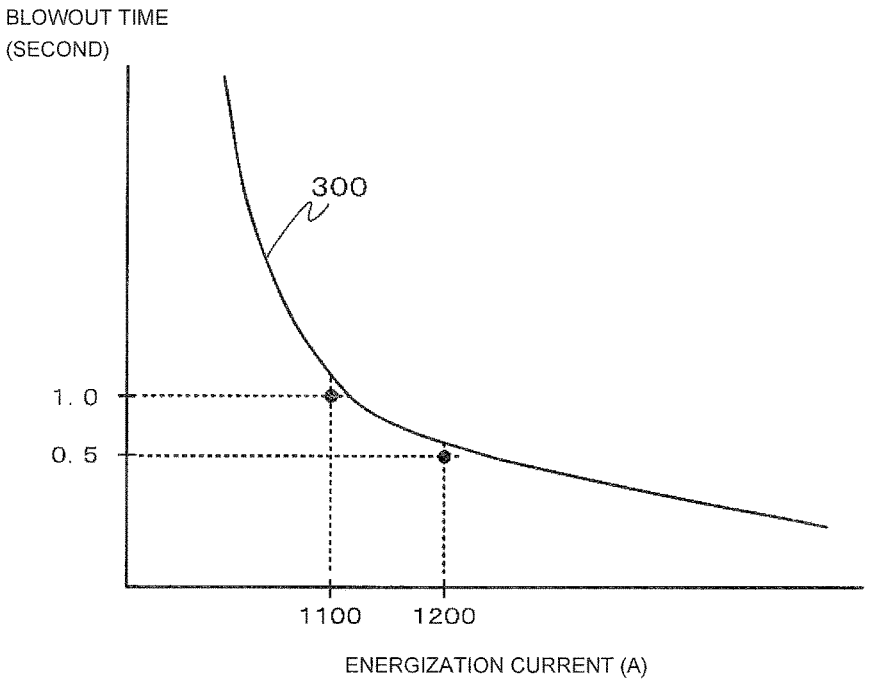
FIG. 3 is a diagram illustrating an example of a prearcing time-current characteristic of a fuse used in a protection circuit.

FIG. 3 is a diagram illustrating an example of a prearcing time-current characteristic of the fuse used in the protection circuit 118. The horizontal axis indicates the energization current value of the fuse, and the vertical axis indicates the time (blowout time) from the start of energization to blowout of the fuse shown in logarithmic scale. Line 300 indicates the blowout time at the energization current values, and blowout does not occur in the area on the left of line 300. It can be seen from FIG. 3 that blowout does not occur even if the energization time is 1.0 seconds and 0.5 seconds when the energization current value is 1100A and 1200A.

In the embodiment, the determination current value is set to 1100A, the first time is set to 0.5 seconds, which is a time within a range where the fuse is not blown out when the energization current of the starter motor 112 is equivalent to the determination current value 1100A as mentioned earlier, and the second time is set to 1 second, which is generally used in the conventional technique as time before load on the starter motor 112 reaches the predetermined level when the energization current is equivalent to the determination current value 1100A, for example. This time "1 second" is set as a value within a range where melting and smoking does not occur on a cover of a motor coil of the starter motor 112 due to heating, even if the maximum current output from the battery 114 flows through the starter motor 112, for example.

Moreover, the lock determination time setting unit 142 sets the lock determination time to the second time, if the ambient temperature acquired from the temperature sensor 126 is lower than a predetermined determination temperature regardless of the size of the energization current of the starter motor 112. This is because the internal resistance value of the battery 114 normally depends on the temperature of the battery 114, and the output current does not become equal to or larger than a certain value even if the SOC is 100%, at a temperature lower than a certain temperature.

Figure 4:
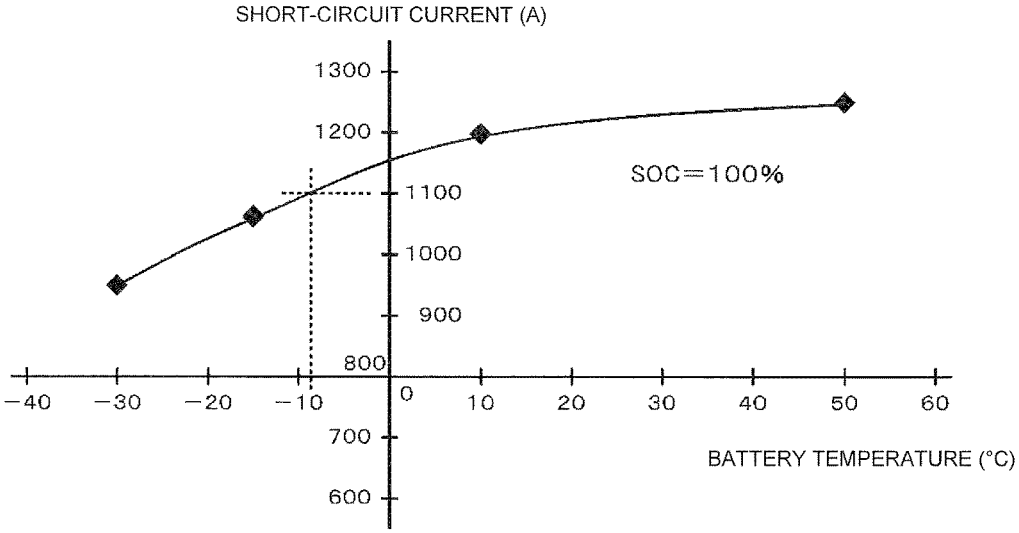
FIG. 4 is a diagram illustrating an example of a temperature dependence of a short-circuit current in a typical lead battery that drives a starter motor.

FIG. 4 is a diagram illustrating an example of temperature dependence of the output current when an output terminal of a typical lead battery is short-circuited at 100% SOC (i.e., short-circuit current at 100% SOC). As illustrated in FIG. 4, the internal resistance of the battery increases with drop in the battery temperature, and therefore the short-circuit current decreases with the drop in the temperature. When the battery temperature is substantially lower than −10° C., the short-circuit current drops below the aforementioned determination current value 1100A of the embodiment. That is, when the battery temperature is substantially lower than −10° C., a current equal to or larger than the determination current value 1100A does not flow through the starter motor.

Accordingly, in the embodiment, the determination temperature is set to −10° C., the ambient temperature acquired from the temperature sensor 126 is used as the battery temperature, and when the ambient temperature is lower than the determination temperature −10° C., the lock determination time is set to the second time regardless of the size of the energization current of the starter motor 112. Note that a temperature outside the host vehicle acquired by a suitable temperature sensor may be used as the battery temperature, instead of the ambient temperature.

The determination unit 144 measures the time elapsed from the start of energization of the starter motor 112 by the energization control unit 130, and also observes the speed of the internal combustion engine 110 acquired from the revolution sensor 124. If the elapsed time exceeds the lock determination time set by the lock determination time setting unit 142 before the speed exceeds a predetermined determination speed (e.g., 50 to 100 revolutions), the determination unit determines that the internal combustion engine 110 is in a locked state.

The startup control device 100 having the above configuration estimates an energization current of the starter motor 112 based on the output voltage and SOC of the battery 114, and sets a lock determination time between the start of energization of the starter motor 112 and determination that the internal combustion engine 110 is in a locked state, according to the size of the estimated energization current. Hence, unlike the conventional technique in which the lock determination time is fixed to a certain value, the startup control device 100 can prevent a state where energization of the starter motor 112 is quickly stopped and startup is obstructed even though the internal combustion engine 110 is capable of starting. The startup control device 100 can also prevent application of load on the starter motor 112 through needlessly long energization of the starter motor 112 and prevent a state of needlessly actuating the protection circuit 118, when the internal combustion engine 110 is in a locked state and cannot be started.

The startup control device 100 is capable of setting a lock determination time according to the size of the estimated energization current, as mentioned above. Hence, by setting the lock determination time according to the prearcing time-current characteristic of a fuse used in the protection circuit 118 or according to a wire smoking characteristic of a wire harness connected to the starter motor 112, the capacity of the fuse used in the protection circuit 118 can be reduced and a wire harness having a smaller diameter can be used.

Next, a processing procedure of the startup control device 100 will be described according to a flowchart illustrated in FIG. 5. The processing starts when the ignition switch 128 is turned on by the driver, and a startup start signal instructing start of the startup of the internal combustion engine 110 is received from the ignition switch 128.

When the processing is started, first, the energization control unit 130 turns on the energization switch 116 to start energization of the starter motor 112, and starts a startup operation of the internal combustion engine 110 by performing cranking (S100). As soon as the energization is started, the determination unit 144 starts measuring the time elapsed from the start of energization. The energization current estimation unit 140 acquires the SOC of the battery 114 from the battery sensor 122 (S102).

Next, the lock determination time setting unit 142 acquires the ambient temperature from the temperature sensor 126 by regarding it as the temperature of the battery 114 (battery temperature) (S104), and determines whether the acquired battery temperature is equal to or higher than the predetermined determination temperature (S108). Then, if the battery temperature is lower than the predetermined determination temperature (S108, No), the lock determination time setting unit 142 sets the lock determination time to the second time longer than the first time (S106), and proceeds to the processing of step S118.

On the other hand, if the battery temperature is equal to or higher than the determination temperature, the energization current estimation unit 140 acquires the current output voltage of the battery 114 from the voltage sensor 120 (S110), refers to the current estimation map stored in the storage device 106, and estimates the current energization current of the starter motor 112 based on the acquired SOC, battery temperature, and current output voltage (S112).

Next, the lock determination time setting unit 142 determines whether the estimated energization current (referred to below as estimated energization current) is equal to or larger than the predetermined determination current value (S114), and if it is smaller than the determination value (S114, No), the lock determination time setting unit proceeds to step S106 and sets the lock determination time to the second time. On the other hand, if the estimated energization current is equal to or larger than the determination current value (S114, Yes), the lock determination time setting unit 142 sets the lock determination time to the first time (S116).

Next, the determination unit 144 and the energization control unit 130 acquire the speed of the internal combustion engine 110 from the revolution sensor 124, and determines whether the speed is equal to or higher than the predetermined determination speed (S118), and if it is equal to or higher than the determination speed (S118, Yes), the energization control unit 130 stops energization of the starter motor 112 (S124) and ends the processing.

Meanwhile, in step S118, if the speed of the internal combustion engine 110 is lower than the determination speed (S118, No), the determination unit 144 determines whether the time elapsed from the start of energization of the starter motor 112 is equal to or longer than the lock determination time (S120), and if it is shorter than the lock determination time (S120, No), the processing returns to step S110 and is repeated.

On the other hand, in step S122, if the time elapsed from the start of energization of the starter motor 112 is equal to or longer than the lock determination time (S120, Yes), the determination unit 144 determines that the internal combustion engine 110 is in a locked state (S122), proceeds to the processing of step S124, and ends the processing after instructing the energization control unit 130 to stop energization of the starter motor 112.

Note that when the determination unit 144 of the lock determination unit 132 determines that the internal combustion engine 110 is in a locked state, as in the conventional technique, information indicating the locked state is notified to an appropriate display control device (not shown) from the startup control device 100, and a display indicating the locked state (e.g., lighting of a predetermined lamp) is shown on a display (not shown) or the like provided inside the host vehicle, for example.

As has been described, in the embodiment, the energization current value of the starter motor 112 is estimated based on the temperature, output voltage, and SOC of the battery 114, and the lock determination time is set according to the size of the estimated energization current value. Hence, unlike the conventional technique in which the lock determination time is fixed to a certain value, the embodiment can prevent a state where energization of the starter motor 112 is stopped too early and startup of the internal combustion engine 110 is obstructed. The embodiment can also prevent application of load on the starter motor 112 through needlessly long energization during a locked state, and prevent undesired actuation of the protection circuit 118.

Note that although the battery SOC is expressed in percentages (%) (i.e., ratio of current remaining power to remaining power in fully charged state) in the embodiment, the invention is not limited to this, and the battery SOC may be expressed by Ah (ampere hour) units. For example, the battery SOC may be expressed by Ah units in the current estimation map pre-stored in the storage device 106, and the SOC of the battery 114 acquired by the battery sensor 122 may also be expressed by Ah units.

Figure 5:
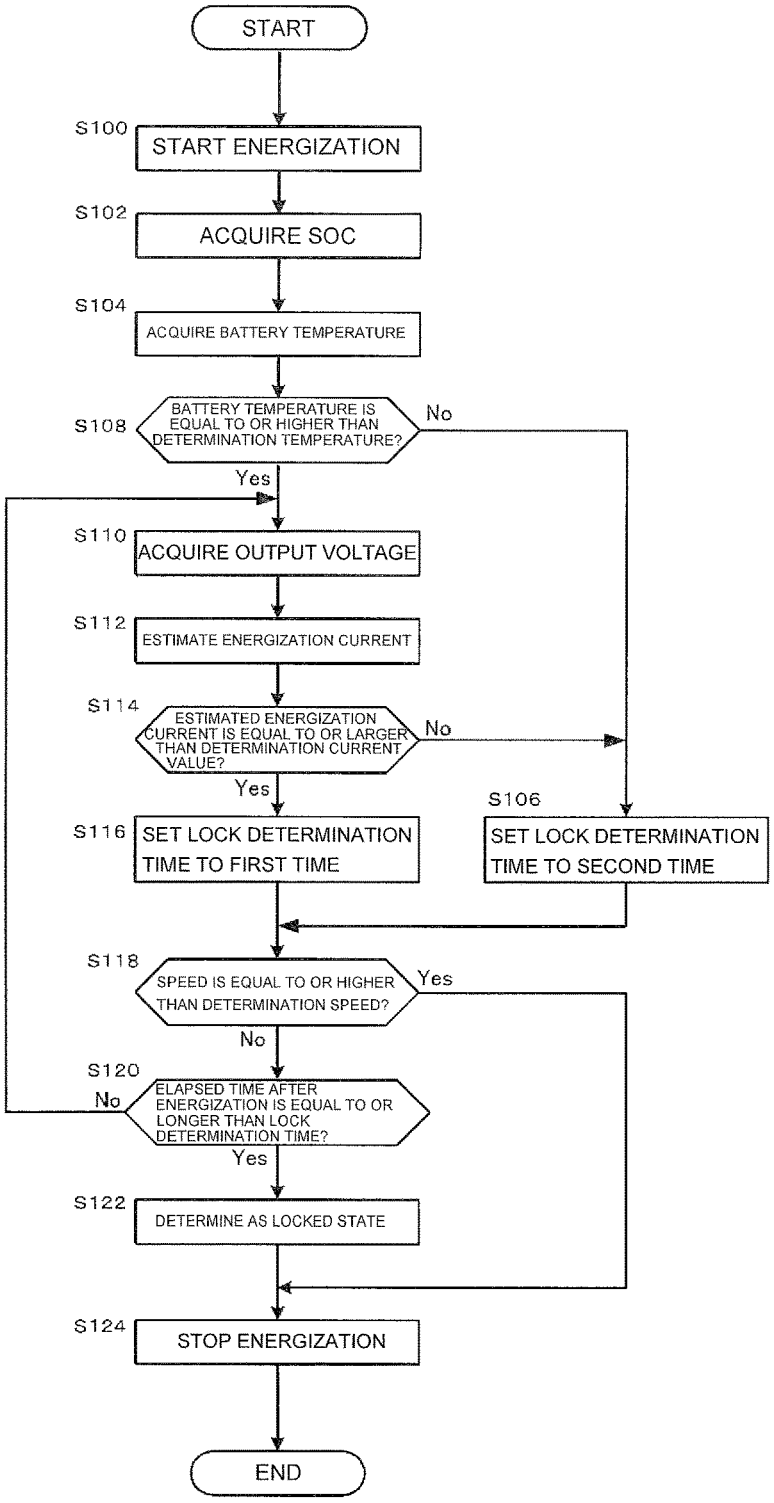
FIG. 5 is a flowchart illustrating a procedure of operations of the startup control device illustrated in FIG. 1.

In the embodiment, in the processing illustrated in FIG. 5, measurement of the battery temperature is not repeated after acquiring the battery temperature in step S104. However, the invention is not limited to this, and if the elapsed time after energization is shorter than the lock determination time in step S120 (S120, No), the processing returns to step S104. The battery temperature is repeatedly acquired after starting energization of the starter motor 112 (S104), and the lock determination time may be set to the second time if the battery temperature is lower than the determination temperature (S108, S106).

Moreover, in the embodiment, acquisition of information from the sensors 120, 122, 124, 126, and the switches 116, 128, and output of instructions to these sensors and switches are directly performed between the sensors and switches and the startup control device 100. However, the invention is not limited to this, and the sensors and switches may each be controlled by an ECU (electronic control unit), and the startup control device 100 may communicate with the ECUs to acquire information from the sensors and switches, and output instructions to the sensors and switches.

In the embodiment, the processing of starting the internal combustion engine 110 illustrated in FIG. 4 is performed when the driver operates the ignition switch 128, for example, and the energization control unit 130 receives a startup start signal instructing start of a startup of the internal combustion engine 110 from the ignition switch 128. However, the invention is not limited to this, and the host vehicle may have an idling stop function, and the processing of starting the internal combustion engine 110 illustrated in FIG. 4 may be started when the driver performs an accelerator operation or steering operation, and the energization control unit 130 acquires information indicating that the accelerator operation or steering operation has been performed from an ECU (not shown) controlling the accelerator or steering operation.

When acquiring information and outputting instructions through such ECUs, the startup control device 100 may be connected to the related ECUs to be capable of communicating therewith by a bus conforming to the CAN (controller area network) communication standard, for example, and may include a communication interface for communicating with the related ECUs according to the communication standard.

In the embodiment, when starting the internal combustion engine 110, the energization current estimation value is calculated by acquiring the SOC of the battery 114 from the battery sensor 122 (step S108 of FIG. 4). However, the invention is not limited to this, and the SOC may be acquired from the battery sensor 122 when operation of the internal combustion engine 110 is stopped by idling stop or turning off of the ignition switch 128, and be stored in the storage device 106. Thereafter, when starting the internal combustion engine 110, the SOC of the battery 114 may be read out from the storage device 106 to calculate the energization current estimation value.

Furthermore, in the embodiment, the energization current estimation value is calculated based on the SOC and output voltage of the battery 114, and the lock determination time is set to the first time when the energization current estimation value is equal to or larger than the predetermined determination current value. However, the invention is not limited to this, and an output voltage when an output current equivalent to the determination current value is applied at the detected SOC of the battery 114 may be estimated from a map as in FIG. 2. If the currently detected output voltage of the battery 114 is lower than the estimated output voltage, it may be determined that an energizing current larger than the determination current value is applied, and set the lock determination time to the first time.

An aspect of the present invention is a startup control device that controls operation of a starter motor for starting an internal combustion engine, the startup control device including: an energization controller that turns on and off energization of the starter motor by a battery; and a lock determination part that determines whether the internal combustion engine is in a locked state where the internal combustion engine is not started by the starter motor. The energization controller is configured to stop energization of the starter motor when the lock determination part determines that the internal combustion engine is in a locked state after energization of the starter motor; and the lock determination part is configured to estimate an energization current value of the starter motor based on a temperature of the battery, an SOC of the battery, and an output voltage of the battery when energizing the starter motor, set, to a first time, a lock determination time between start of energization of the starter motor and determination that the internal combustion engine is in a locked state, according to the estimated energization current value, and determine that the internal combustion engine is in a locked state if a speed of the internal combustion engine does not exceed a predetermined speed before an elapsed time after energization of the starter motor exceeds the set lock determination time.

According to another aspect of the present invention, the lock determination part is configured to also set the lock determination time to a second time longer than the first time if a temperature of the battery is lower than a predetermined temperature, regardless of an energization current value of the starter motor.

According to another aspect of the present invention, the lock determination part uses any of an ambient temperature and an outdoor temperature as the temperature of the battery.

According to another aspect of the present invention, the first time is a predetermined constant value, and the lock determination part sets the lock determination time to the first time if the estimated energization current value is equal to or larger than a predetermined value, and sets the lock determination time to the second time if the estimated energization current value is smaller than a predetermined value.

According to another aspect of the present invention, the first time is set to a value within a range where a fuse provided in a power supply route from the battery to the starter motor is not blown out, when a current equivalent to the estimated energization current value actually flows through the starter motor.

Another aspect of the present invention is a lock determination method of determining whether an internal combustion engine is in a locked state where the internal combustion engine is not started by a starter motor, the method including the steps of: acquiring an SOC of a battery that energizes the starter motor; acquiring an output voltage of the battery when energizing the starter motor; estimating an energization current value of the starter motor based on a temperature of the battery, the acquired SOC, and the output voltage; setting, to a first time, a lock determination time between start of energization of the starter motor and determination that the internal combustion engine is in a locked state, according to the estimated energization current value; and determining that the internal combustion engine is in a locked state if a speed of the internal combustion engine does not exceed a predetermined speed before an elapsed time after energization of the starter motor exceeds the set lock determination time.

According to another aspect of the present invention, in the lock determination time setting step, the lock determination time is set to a second time longer than the first time if a temperature of the battery is lower than a predetermined temperature.

According to another aspect of the present invention, the first time is a predetermined constant value, and in the lock determination time setting step, the lock determination time is set to the first time if the estimated energization current value is equal to or larger than a predetermined value, and the lock determination time is set to a second time longer than the first time if the estimated energization current value is smaller than a predetermined value.

Obviously, numerous modifications and variations of the present invention are possible in light of the above teachings. It is therefore to be understood that within the scope of the appended claims, the invention may be practiced otherwise than as specifically described herein.

What is claimed is:

1. A startup control device that controls operation of a starter motor for starting an internal combustion engine, the startup control device comprising:

an energization controller that turns on and off energization of the starter motor by a battery; and a lock determination part that determines whether said internal combustion engine is in a locked state where the internal combustion engine is not started by said starter motor, wherein:

said energization controller is configured to stop energization of said starter motor when said lock determination part determines that said internal combustion engine is in a locked state after energization of said starter motor; and said lock determination part is configured to estimate an energization current value of said starter motor based on a temperature of said battery, an SOC of said battery, and an output voltage of said battery when energizing said starter motor, set, to a first time, a lock determination time between start of energization of said starter motor and determination that said internal combustion engine is in a locked state, according to said estimated energization current value, and determine that said internal combustion engine is in a locked state if a speed of said internal combustion engine does not exceed a predetermined speed before an elapsed time after energization of said starter motor exceeds said set lock determination time.

2. The startup control device according to claim 1, wherein said lock determination part also sets said lock determination time to a second time longer than said first time if a temperature of said battery is lower than a predetermined temperature, regardless of an energization current value of said starter motor.

3. The startup control device according to claim 1, wherein said lock determination part uses any of an ambient temperature and an outdoor temperature as the temperature of said battery.

4. The startup control device according to claim 1, wherein:

said first time is a predetermined constant value; and said lock determination part sets said lock determination time to said first time if said estimated energization current value is equal to or larger than a predetermined value, and sets said lock determination time to a second time longer than said first time if said estimated energization current value is smaller than a predetermined value.

5. The startup control device according to claim 1, wherein said first time is set to a value within a range where a fuse provided in a power supply route from said battery to said starter motor is not blown out, when a current equivalent to said estimated energization current value actually flows through said starter motor.

6. A lock determination method of determining whether an internal combustion engine is in a locked state where the internal combustion engine is not started by a starter motor, the method comprising the steps of:

acquiring an SOC of a battery that energizes said starter motor;

acquiring an output voltage of said battery when energizing said starter motor;

estimating an energization current value of said starter motor based on a temperature of said battery, said acquired SOC, and said output voltage;

setting, to a first time, a lock determination time between start of energization of said starter motor and determination that said internal combustion engine is in a locked state, according to said estimated energization current value; and determining that said internal combustion engine is in a locked state if a speed of said internal combustion engine does not exceed a predetermined speed before an elapsed time after energization of said starter motor exceeds said set lock determination time.

7. The lock determination method according to claim 6, wherein in said lock determination time setting step, said lock determination time is set to a second time longer than said first time if a temperature of said battery is lower than a predetermined temperature.

8. The lock determination method according to claim 6, wherein any of an ambient temperature and an outdoor temperature is used as the temperature of said battery.

9. The lock determination method according to claim 6, wherein:

said first time is a predetermined constant value; and in said lock determination time setting step, said lock determination time is set to said first time if said estimated energization current value is equal to or larger than a predetermined value, and said lock determination time is set to a second time longer than said first time if said estimated energization current value is smaller than a predetermined value.

10. The lock determination method according to claim 6, wherein said first time is set to a value within a range where a fuse provided in a power supply route from said battery to said starter motor is not blown out, when a current equivalent to said estimated energization current value actually flows through said starter motor.

11. A startup control device to control a starter motor, comprising:

lock determination circuitry configured to estimate a current value supplied to the starter motor based on a temperature of a battery that is configured to supply electricity to the starter motor to start an internal combustion engine, a remaining electricity amount in the battery, and an output voltage of the battery when the battery supplies the electricity to the starter motor, determine a threshold period of time according to the current value estimated, and determine that the internal combustion engine does not start if a rotational speed of the internal combustion engine does not exceed a referenced speed within the threshold period of time after starting supplying electricity to the starter motor; and motor control circuitry to stop supplying electricity to the starter motor when the lock determination circuitry determines that the internal combustion engine does not start after starting supplying electricity to the starter motor.

12. The startup control device according to claim 11, wherein the lock determination circuitry lengthens the threshold period of time if the temperature of the battery is lower than a predetermined temperature.

13. The startup control device according to claim 11, wherein the lock determination circuitry uses any one of an ambient temperature and an outdoor temperature as the temperature of the battery.

14. The startup control device according to claim 11, wherein the lock determination circuitry does not lengthen the threshold period of time if the current value estimated is equal to or larger than a predetermined value, and lengthens the threshold period of time if the current value estimated is smaller than a predetermined value.

15. The startup control device according to claim 11, wherein the threshold period of time is determined such that a fuse provided in a power supply route from the battery to the starter motor is not blown out, when a current equivalent to the current value estimated actually flows through the starter motor.

16. A method for controlling a starter motor, the method comprising:

estimating a current value supplied to the starter motor based on a temperature of a battery that is configured to supply electricity to the starter motor to start an internal combustion engine, a remaining electricity amount in the battery, and an output voltage of the battery when the battery supplies the electricity to the starter motor;

determining a threshold period of time according to the current value estimated; and determining that the internal combustion engine does not start if a rotational speed of the internal combustion engine does not exceed a referenced speed within the threshold period of time after starting supplying electricity to the starter motor.

17. The method according to claim 16, wherein the threshold period of time is lengthened if the temperature of the battery is lower than a predetermined temperature.

18. The method according to claim 16, wherein any one of an ambient temperature and an outdoor temperature is used as the temperature of the battery.

19. The method according to claim 16, wherein the threshold period of time is not lengthened if the current value estimated is equal to or larger than a predetermined value, and the threshold period of time is lengthened if the current value estimated is smaller than a predetermined value.

20. The method according to claim 16, wherein the threshold period of time is determined such that a fuse provided in a power supply route from the battery to the starter motor is not blown out, when a current equivalent to the current value estimated actually flows through the starter motor.

* * * * *